US011008161B2

(12) United States Patent
Richter et al.

(10) Patent No.: US 11,008,161 B2
(45) Date of Patent: May 18, 2021

(54) TRANSPORT AND STORAGE CONTAINER OF PLASTIC FOR A FILLING MATERIAL

(71) Applicant: Rikutec Richter Kunststofftechnik GmbH & Co. KG, Altenkirchen (DE)

(72) Inventors: Bodo Richter, Altenkirchen (DE); Guenter Richter, Altenkirchen (DE); Guenter Luettgens, Odenthal (DE); Sylvia Luettgens, Odenthal (DE)

(73) Assignee: Bodo Richter

( * ) Notice: Subject to any disclaimer, the term of this patent is extended or adjusted under 35 U.S.C. 154(b) by 292 days.

(21) Appl. No.: 16/068,515

(22) PCT Filed: Dec. 29, 2016

(86) PCT No.: PCT/EP2016/082821
§ 371 (c)(1),
(2) Date: Jul. 6, 2018

(87) PCT Pub. No.: WO2017/118589
PCT Pub. Date: Jul. 13, 2017

(65) Prior Publication Data

US 2019/0023486 A1 Jan. 24, 2019

(30) Foreign Application Priority Data

Jan. 8, 2016 (DE) ..... 20 2016 100 050.5

(51) Int. Cl.
*B65D 90/46* (2006.01)

(52) U.S. Cl.
CPC ..... *B65D 90/46* (2013.01)

(58) Field of Classification Search
CPC ..... B65D 88/54
See application file for complete search history.

(56) References Cited

U.S. PATENT DOCUMENTS 4,089,417 A * 5/1978 Osborne ..... B65D 19/20 108/56.1
4,360,045 A * 11/1982 Ahlers ..... B67C 3/12 141/39

(Continued)

FOREIGN PATENT DOCUMENTS

CN 1221699 A 7/1999
CN 1475418 A 2/2004

(Continued)

OTHER PUBLICATIONS

English Translation of Chinese Patent Application 201680057831.X Office Action dated Apr. 1, 2019 (patent family member).

*Primary Examiner* — Peter M Novak
(74) *Attorney, Agent, or Firm* — Schlee IP International, PC; Alexander R. Schlee

(57) ABSTRACT

A transport and storage container of plastic for a filling material, having an inner container of polyethylene which is produced in the blow-molding method and which has a single-layer wall structure. The inner container is accommodated by an outer container, which is open at the top and which contains at least one layer of electrically conductive plastic. The outer lateral surface of the inner container is wrapped with an electrically dissipative flexible material, wherein at least one electrically conductive tab covers at least part of the top side of the inner container.

14 Claims, 5 Drawing Sheets

(56) References Cited

U.S. PATENT DOCUMENTS

| | | | | | |
|---|---|---|---|---|---|
| 5,971,185 | A * | 10/1999 | Schutz | B65D 77/0466 | 220/1.6 |
| 6,050,437 | A * | 4/2000 | Schutz | B65D 77/0466 | 220/4.12 |
| 10,343,831 | B2 * | 7/2019 | Weyrauch | A62C 3/065 | |
| 2004/0195129 | A1 * | 10/2004 | Richter | B65D 77/0466 | 206/386 |
| 2012/0037649 | A1 * | 2/2012 | Schutz | B67D 7/3236 | 220/694 |
| 2013/0091961 | A1 * | 4/2013 | Taylor | G01L 1/18 | 73/862.541 |
| 2018/0002079 | A1 * | 1/2018 | Saito | B65D 47/14 | |

FOREIGN PATENT DOCUMENTS

| | | | |
|---|---|---|---|
| CN | 1500709 | A | 6/2004 |
| DE | 9417151 | | 2/1996 |
| DE | 9417151 | U1 | 2/1996 |
| DE | 20107962 | | 7/2002 |
| DE | 20107962 | U1 | 7/2002 |
| DE | 10161693 | | 7/2003 |
| DE | 10161693 | A1 | 7/2003 |
| DE | 10242956 | | 3/2004 |
| DE | 10242956 | A1 | 3/2004 |
| EP | 0893362 | | 1/1999 |
| EP | 0893362 | A1 | 1/1999 |

* cited by examiner

TRANSPORT AND STORAGE CONTAINER OF PLASTIC FOR A FILLING MATERIAL

CROSS REFERENCE TO RELATED APPLICATION

This application is a national phase of the International Application PCT/EP2016/082821 filed Dec. 29, 2016, claiming priority of the German Patent Application DE 20 2016 100 050.5 filed Jan. 8, 2016. The content of this aforementioned document is herewith incorporated by reference.

BACKGROUND OF THE INVENTION

The invention relates to a plastic transport and storage container for a filling material, comprising an inner container having a capacity of 50 to 5000 L for receiving the filling material and an outer container which is open at the top and accommodates the inner container and includes at least one layer made of electrically conductive plastic material.

A container of this type is known from DE 201 07 962 U1. For preventing electrostatic chargings which may result in gas discharges, a conductive filler is admixed to the plastic material of the inner container so that a certain electrical conductivity and thus an electrically antistatic or charge-dissipating effect is achieved. The outer container is likewise made of plastic material and has a multi-layer structure, with its inner layer and its outer layer being formed of electrically conductive plastic material.

In the case of a highly pure filling material, such as in the chemical industry, also the plastic material for the inner container must have a very high purity. However, due to admixture of electrically conductive fillers and the use of co-extrusion blow molding it cannot be guaranteed that no impurities are released from the container walls to the filling material. Moreover, the manufacture of multi-layer walls for the inner container using blow molding is complex.

SUMMARY OF THE INVENTION

It is the object of the invention to specify a plastic transport and storage container for a filling material, which is impurity-free, guarantees high safety standards and can be economically manufactured.

According to an aspect of the invention, this is achieved by a plastic transport and storage container for a filling material, comprising an inner container there is with a capacity of 50 to 5000 L for receiving the filling material, which is made of plastic material and has a single-layer wall structure, an outer container which is open at the top, accommodates the inner container and includes at least one layer of electrically conductive plastic material, wherein the outer circumferential surface of the inner container, which is closed at the top, is surrounded by an electrically conductive flexible material, at least one electrically conductive flap which covers at least a part of the upper side of the inner container, the flap being electrically connected to the electrically conductive material on the circumferential surface of the inner container, and wherein a lid comprising at least one layer of electrically conductive plastic material covers the outer container.

According to the invention, the inner container, which is preferably manufactured by blow molding, has a single-layer wall structure and is preferably made of stabilizer-free polyethylene, in particular of HDPE (high density polyethylene) of high purity. To protect against electrostatic chargings, the outer circumferential surface, in particular the vertical side surfaces in the case of a cuboid-shaped inner container, is surrounded by an electrically conductive flexible material. At least one electrically conductive flap is arranged such that it covers at least a part of the upper side of the inner container, wherein the flap is electrically connected to the electrically conductive material on the circumferential surface of the inner container. In this way, a large part of the inner container is electrically shielded, and no local electrostatic charges which might result in an electrostatic gas discharge will build up. The outer container includes at least one layer of electrically conductive plastic material so that also the underside of the inner container that, due to its own weight, rests on the bottom of the outer container is well shielded. The flap can be formed in one piece with the material surrounding the circumferential surface of the inner container. It is likewise possible to form the flap as a separate piece. Preferably, the material of the flap is the same as the material surrounding the circumferential surface.

According to a preferred embodiment, an antistatic, electrically conductive plastic foil is used as a conductive material. Alternatively, instead of the surrounding plastic foil, a non-conductive plastic fabric can be used, into which single conductive threads ($<10^6$ ohm) are woven in warp and weft direction, which threads are in electrical contact with each other and are connected to the electrically conductive flap. Moreover, instead of the surrounding plastic foil a non-conductive woven fabric made of plastic material can be used, into which single conductive strips ($<10^6$ ohm) are woven in warp and weft direction, which strips are in electrical contact with each other and are connected to the electrically conductive flap.

BRIEF DESCRIPTION OF THE DRAWINGS

Embodiments of the invention are explained in the following on the basis of the drawings.

DETAILED DESCRIPTION OF THE DRAWINGS

Figure 1:
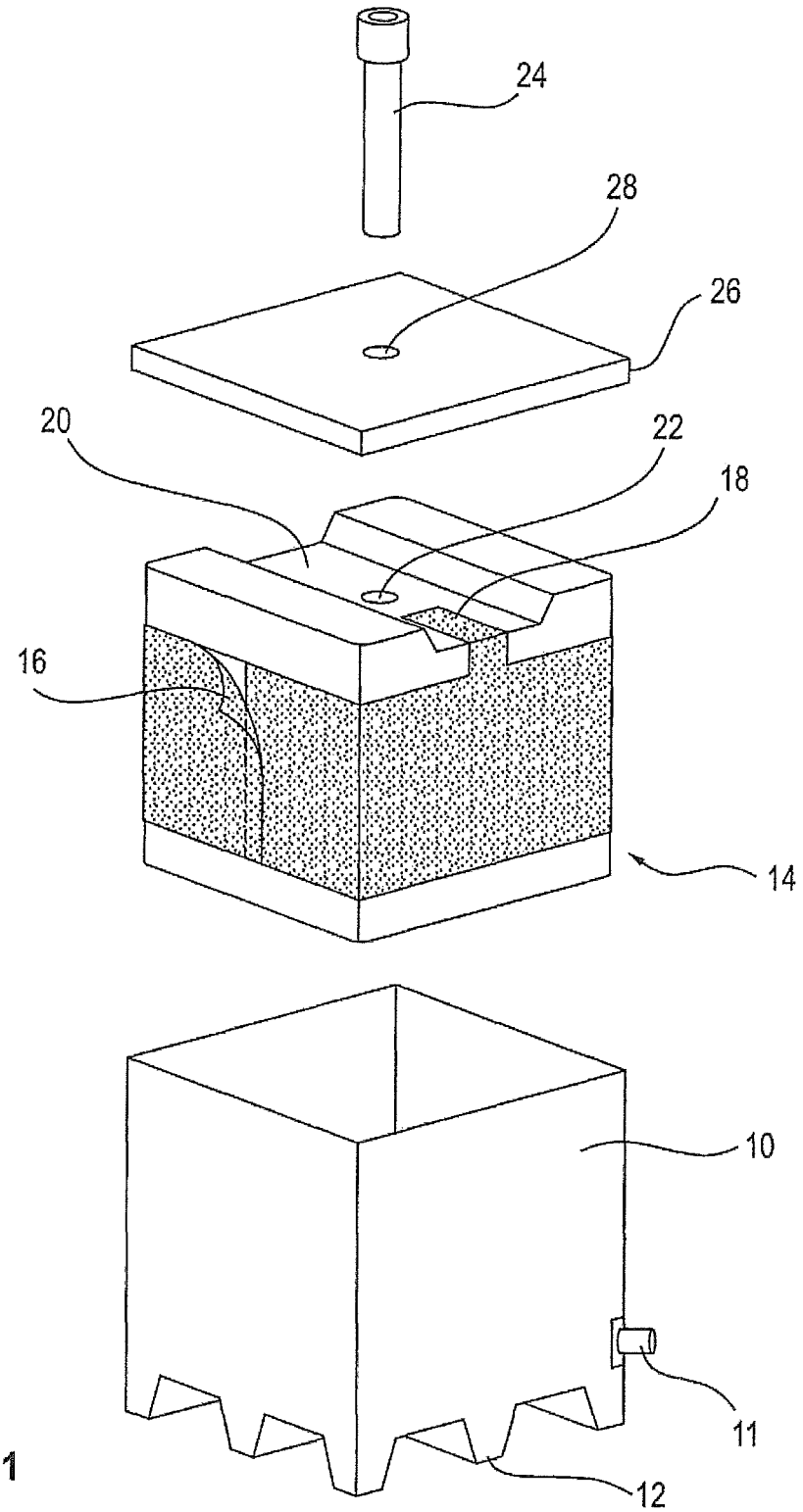
FIG. 1 shows a transport and storage container in an exploded view.

In FIG. 1, essential parts of the transport and storage container are shown in an exploded view. A cuboid-shaped stable outer container 10 with a stable frame structure 12 at the bottom is suited to accommodate a cuboid-shaped inner container 14. This inner container 14 is manufactured by blow molding and serves to receive a filling material, in general a highly pure liquid, preferably a flammable liquid. The inner container 14, which is closed at the top, is made of stabilizer-free polyethylene, preferably highly pure HDPE, with a single-layer wall structure. The purity of this plastic material is such that the inner container releases impurities with less than 100 ppt (parts per trillion, corresponding to $10^{-12}$) to the filling material. The vertical side surfaces of the inner container, i.e. its circumferential surface, is closely surrounded by an electrically conductive plastic foil 16, which is, for example, applied by adhesion. The ends of the plastic foil 16 firmly applied to the vertical side surfaces of the cuboid-shaped inner container 14 overlap each other. On one side, a plastic foil flap 18 extends upwards and covers a part of the upper side 20 of the inner container 14. As illustrated here, the flap 18 is integrally formed with the plastic foil 16. However, a separate plastic foil flap 18 can likewise be used, which flap overlaps with the plastic foil 16 to establish an electrical connection between the flap 18 and the plastic foil 16. Likewise, it is also possible to provide further flaps 18 at several side surfaces of the inner container 14 to cover an even greater part of the upper side 20 of the inner container 14. In the upper side 20, an opening 22 is provided for receiving a tube 24 for filling and emptying for the filling material.

A cover or a lid 26 comprising at least one layer of electrically conductive plastic material serves to cover the outer container 10. In this lid 26, the electrically conductive tube 24 can be mounted in an opening 28. On the outside of the outer container 10, an electrical connection 11 can be provided which serves for grounding. The lid 26 can have a three-layer structure as the outer container 10 explained further below or can also only be made up of one single layer made of electrically conductive plastic material.

Figure 2:
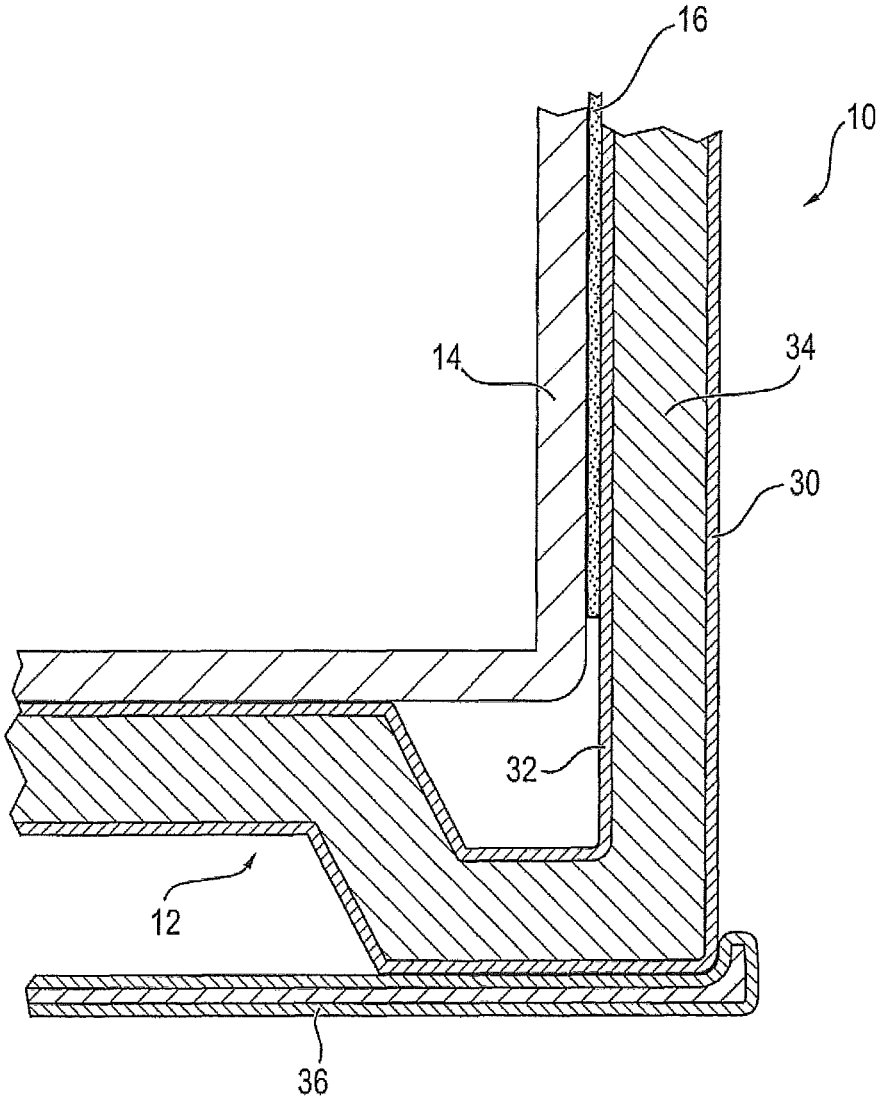
FIG. 2 shows a partial cross-section of the lower portion of the container.

FIG. 2 shows a partial cross-section of a lower portion of the inner container 14 accommodated within the outer container 10. The outer container 10 has a three-layer wall structure with outer layers 30, 32 made of electrically conductive plastic material, e.g. HDPE enriched with an electrical filler, and a foamed middle layer 34 made of HDPE. The inner container 14 is supported on the lower frame structure 12 and laterally bears against the side walls of the outer container 10. Here, the plastic foil 16 surrounding the circumferential surface of the inner container 14 can contact the electrically conductive outer layer 32 and thus establish electrical contact. The bottom structure 12 rests on a pallet 36 having the same structure as the outer container 10. This pallet 36 can serve for grounding via its electrically conductive outer layers.

The outer layers 30, 32 of the outer container 10 typically have a conductivity of $<10^6$ ohm. The electrically conductive plastic foil 16 has an electrical conductivity of $<10^6$ ohm.

Figure 3:
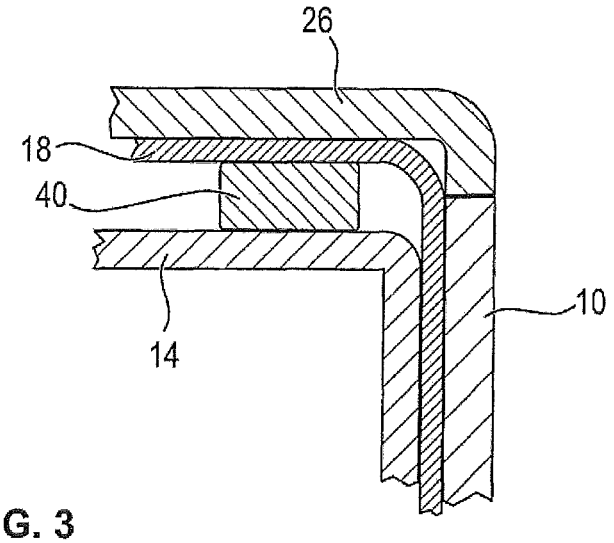
FIG. 3 shows the arrangement of an elastic connecting element between the upper side of the inner container and the electrically conductive foil.

FIG. 3 shows a cross-section through the upper portion of the inner container 14 received by the outer container 10 and the lid 26. An elastic element 40, for example made of foam material or sheet metal, is arranged as an electrical connecting element between the upper side of the inner container 14 and the flap 18. When closing the outer container 10 by means of the lid 26, the flap 18 is clamped between the upper side of the elastic element 40 and the underside of the lid 26 with elastic pressure so that an electrical connection with the electrically conductive plastic layer of the lid 26 is established. The elastic element 40 can be formed electrically isolating.

Figure 4:
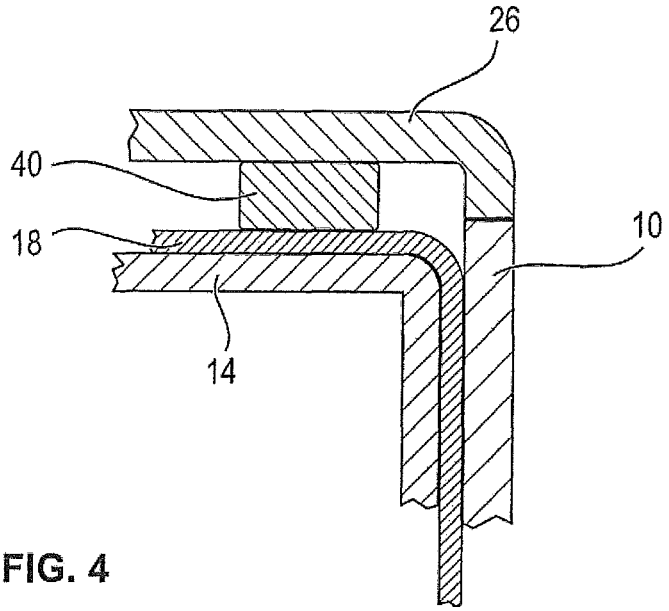
FIG. 4 shows the arrangement of the elastic connecting element between the lid and the plastic foil.

In FIG. 4, an alternative thereto is indicated. The elastic element 40 is arranged between the underside of the lid 26 and the flap 18 and, when closing the lid 26, it presses the flap 18 against the upper side of the inner container 14. In order to establish a reliable electrical contact, the surface of the elastic element 40 is electrically conductive. For reasons of a simplified handling, the flap 18 is not firmly connected to the lid 26.

Figure 5:
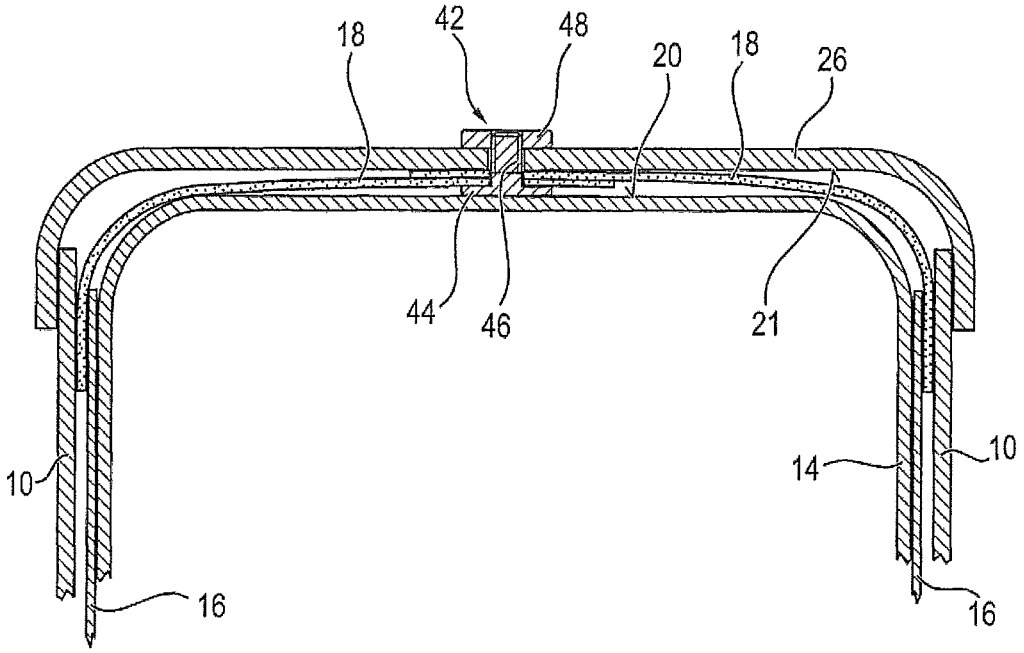
FIG. 5 shows an arrangement with a mounting element as a connecting element.

FIG. 5 shows an arrangement with a mounting element 42 as an electrical connecting element. In this example, two overlapping flaps 18 are arranged. Here, the lid 26 has a single wall made of electrically conductive plastic material and laterally overlaps the outer container 10. The mounting element 42 comprises a screw connection with bottom portion 44, threaded portion 46 and threaded nut 48. The overlapping flaps 18 are clamped between the bottom portion 44 and the underside 21 of the lid 26 and thus establish an electrical connection between the electrically conductive material 16 and the lid 26.

Figure 6:
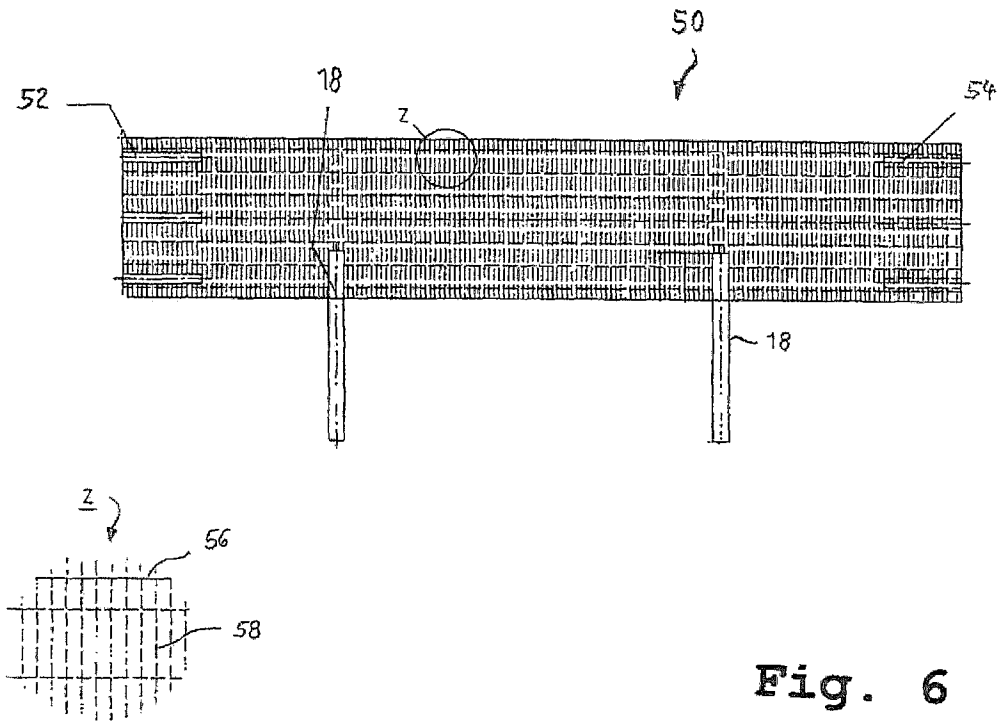
FIG. 6 shows an electrically conductive woven fabric with flaps sewed thereon.

FIG. 6 shows an embodiment with a woven fabric 50 as an electrically conductive material. The woven fabric comprises woven polypropylene and includes electrostatically conductive threads according to norm IEC 61340-4-4 for type C. The woven fabric 50 is placed around the circumferential surface of the inner container as a banderole and is fixed by means of sewed-on Velcro strips 52, 54.

Flaps 18 made of electrostatic material are sewed onto the woven fabric 50. In an enlarged section Z, electrostatically conductive threads 56, 58 woven in in warp and weft direction can be seen, which are in electrical contact with each other. The inner container 14 can have a volume of 50 to 5000 liters. As a filling material, a chemically highly pure material, for example also a flammable liquid, is suited. By way of the electrical shielding made and an electrical grounding of the entire container via the electrical connection 11 or the pallet 36, electrostatic charges are discharged and the risk of an ignitable gas discharge is ruled out. In this way, an internationally required safety standard is guaranteed.

On the lid 26 and/or on the inner container 14, further elements, such as filler neck, seal, overflow gutter, emptying tube, etc. can be provided, as this is, for example, described in DE 201 07 962 U1 mentioned further above. By using a single-layer inner container, this container can be manufactured economically and the risk of impurities caused by the material of the inner container can be reduced. Outer and inner containers can have different shapes, for example, also the shape of a barrel.

LIST OF REFERENCE SIGNS

10 outer container
11 electrical connection
12 frame structure
14 inner container
16 plastic foil
18 flap
20 upper side of the inner container
21 underside of the lid
22 opening
24 tube
26 lid
30, 32 outer layers of the outer container
34 middle layer
36 pallet
40 elastic element
42 mounting element
44 bottom portion
46 threaded portion
48 nut
50 woven fabric
52, 54 Velcro strips
56, 58 electrically conductive threads

What is claimed is:

1. A plastic transport and storage container for a filling material, comprising:

an inner container there is with a capacity of 50 to 5000 L for receiving the filling material, which is made of plastic material and has a single-layer wall structure;

an outer container which is open at the top, accommodates the inner container and includes at least one layer of electrically conductive plastic material;

wherein an outer circumferential surface of the inner container, which is closed at the top, is surrounded by an electrically conductive flexible material;

at least one electrically conductive flap which covers at least a part of the upper side of the inner container, the flap being electrically connected to the electrically conductive material on the circumferential surface of the inner container;

wherein a lid comprising at least one layer of electrically conductive plastic material covers the outer container;

wherein between the upper side of the inner container and the lid a connecting element is arranged such that the flap is connected to the electrically conductive layer of the lid in an electrically conductive manner in the closed state of the outer container; and wherein the connecting element is a mounting element that comprises a screw connection with a bottom portion clamping the flap between the bottom portion and the underside of the lid to establish an electrical connection between the flap and the lid.

2. The transport and storage container according to claim 1, wherein the connecting element is arranged between the upper side of the inner container and the lid.

3. The transport and storage container according to claim 1, wherein the inner container is made of polyethylene and is manufactured by blow molding.

4. The transport and storage container according to claim 1, wherein the electrically conductive material is adhered to the circumferential surface of the inner container.

5. The transport and storage container according to claim 1, wherein the electrically conductive flexible material is an electrically conductive plastic foil.

6. The transport and storage container according to claim 1, wherein the electrically conductive plastic foil has an electrical resistivity of $<10^6$ ohm.

7. The transport and storage container according to claim 1, wherein electrically conductive woven fabric is used as an electrically conductive material, which comprises non-conductive plastic fabric or plastic strips, into which electrically conductive threads or strips are woven which are in electrical contact with each other.

8. The transport and storage container according to claim 1, wherein the outer container is made of a multi-layer plastic material, the outer layers of which are electrically conductive.

9. The transport and storage container according to claim 1, wherein the outer layers of the outer container have an electrical resistivity of $<10^6$ ohm.

10. The transport and storage container according to claim 1, wherein the inner container receives an electrically conductive dip tube for filling and emptying for the filling material.

11. The transport and storage container according to claim 1, wherein the bottom of the outer container has an electrically conductive and stable frame structure.

12. The transport and storage container according to claim 1, wherein the flap is made of the same material as the material surrounding the circumferential surface.

13. The transport and storage container according to claim 1, wherein the outer container comprises an electrical connection for an electrical earth connection.

14. A plastic transport and storage container for a filling material, comprising:

an inner container there is with a capacity of 50 to 5000 L for receiving the filling material, which is made of plastic material and has a single-layer wall structure;

an outer container which is open at the top, accommodates the inner container and includes at least one layer of electrically conductive plastic material;

wherein an outer circumferential surface of the inner container, which is closed at the top, is surrounded by an electrically conductive flexible material;

at least one electrically conductive flap which covers at least a part of the upper side of the inner container, the flap being electrically connected to the electrically conductive material on the circumferential surface of the inner container;

wherein a lid comprising at least one layer of electrically conductive plastic material covers the outer container;

wherein between the upper side of the inner container and the lid a connecting element is arranged such that the flap is connected to the electrically conductive layer of the lid in an electrically conductive manner in the closed state of the outer container; and wherein the connecting element is an elastic element that is arranged between the upper side of the inner container and the flap or between the underside of the lid and the flap so that the lid when closed clamps the flap into electric contact with the lid by elastic pressure.

* * * * *